US012371241B2

(12) United States Patent
Li

(10) Patent No.: US 12,371,241 B2
(45) Date of Patent: Jul. 29, 2025

(54) MODULAR SPRING BIAS CAVITY

(71) Applicant: Ming Yong Li, Montebello, CA (US)

(72) Inventor: Ming Yong Li, Montebello, CA (US)

( * ) Notice: Subject to any disclaimer, the term of this patent is extended or adjusted under 35 U.S.C. 154(b) by 50 days.

(21) Appl. No.: 18/194,970

(22) Filed: Apr. 3, 2023

(65) Prior Publication Data

US 2024/0327094 A1 Oct. 3, 2024

(51) Int. Cl.

| | |
|---|---|
| ***B65D 81/07*** | (2006.01) |
| ***B65D 81/02*** | (2006.01) |
| ***B65D 81/05*** | (2006.01) |
| ***B65D 81/32*** | (2006.01) |

(52) U.S. Cl.

CPC ..... *B65D 81/07* (2013.01); *B65D 81/022* (2013.01); *B65D 81/051* (2013.01); *B65D 81/3205* (2013.01)

(58) Field of Classification Search

CPC .... B65D 81/07; B65D 81/022; B65D 81/051; B65D 81/3205; B65D 81/113

USPC ..... 206/583, 585, 592, 591, 588, 589, 594; 220/62.11, 62.19, 62.2, 648, 649, 652, 220/654, 520, 513, 510, 515, 507, 509

See application file for complete search history.

(56) References Cited

U.S. PATENT DOCUMENTS

| | | | | | |
|---|---|---|---|---|---|
| 3,181,693 | A * | 5/1965 | Freistat | A45C 13/02 | 217/69 |
| 3,241,661 | A * | 3/1966 | Zamzow | B65D 81/022 | 217/19 |
| 4,628,705 | A * | 12/1986 | Nave | F25D 3/08 | 62/530 |
| 5,833,057 | A * | 11/1998 | Char | B65D 81/26 | 229/148 |
| 6,929,125 | B1 * | 8/2005 | Seamans | B65D 81/07 | 206/316.1 |
| 7,178,343 | B2 * | 2/2007 | Linder | F25B 21/02 | 62/3.6 |
| 8,727,123 | B1 * | 5/2014 | Roberts | B65D 81/075 | 206/583 |
| 11,124,348 | B2 * | 9/2021 | McDonald | B65D 81/075 | |
| 2009/0188833 | A1 * | 7/2009 | Klos | B65D 81/07 | 53/472 |
| 2021/0347523 | A1 * | 11/2021 | Southwell | B65D 5/5035 | |

* cited by examiner

*Primary Examiner* — Orlando E Aviles
*Assistant Examiner* — Jenine Pagan
(74) *Attorney, Agent, or Firm* — Clement Cheng

(57) ABSTRACT

A modular spring bias cavity device which includes a base and side external walls extending from the base. A cover fits over the side external walls. A support structure has a support structure first cavity. The support structure is mounted to the base. A suspension frame has a first suspension frame cavity that fits over the support structure first cavity. The suspension frame is formed as a resilient and flexible structure. A suspension frame overlap extends downwardly at a periphery of the extension frame. The suspension frame overlap overlaps the support structure. A channel frame is mounted to the support structure around a support structure sidewall. The channel frame fits within a channel formed between the suspension frame overlap and the support structure.

16 Claims, 8 Drawing Sheets

MODULAR SPRING BIAS CAVITY

FIELD OF THE INVENTION

The present invention is in the field of modular spring bias cavities.

DISCUSSION OF RELATED ART

A variety of different wine bottle carriers and luggage equipment have been described in patent literature. Unfortunately, most configurations do not preserve glass wine bottles when dropped from more than the height of a person.

SUMMARY OF THE INVENTION

A modular spring bias cavity device which includes a base and side external walls extending from the base. A cover fits over the side external walls. A support structure has a support structure first cavity. The support structure is mounted to the base. A suspension frame has a first suspension frame cavity that fits over the support structure first cavity. The suspension frame is formed as a resilient and flexible structure. A suspension frame overlap extends downwardly at a periphery of the extension frame. The suspension frame overlap overlaps the support structure. A channel frame is mounted to the support structure around a support structure sidewall. The channel frame fits within a channel formed between the suspension frame overlap and the support structure.

The cover further includes a cover cushion, wherein the cover cushion further includes a first cover cushion cavity indent conforming to a profile of the first suspension frame cavity. The cover further includes an opening side cushion indent, wherein the opening side cushion indent rests upon a front engagement shoulder of the suspension frame. The channel frame is more rigid in a vertical orientation than in a horizontal orientation. The support structure has a first suspension cavity and a second suspension cavity. The cover has a first cover cushion cavity indent and a second cover cushion cavity indent. The first cover cushion cavity indent is aligned to the first suspension cavity. The second cover cavity indent is aligned to the second suspension cavity. The suspension frame has a suspension frame rear corner toward a hinge side. The cover has a closing side cushion indent that engages with a rear engagement shoulder formed on the support structure.

The suspension frame suspends the first suspension cavity above a first cavity gap. The first cavity gap is formed between the first suspension cavity and the support structure. The suspension frame suspends the second suspension cavity above a second cavity gap. The second cavity gap is formed between the second suspension cavity and the support structure. The front tape connector connects the suspension frame to the side external wall. A rear tape connector connects the suspension frame to the side external wall. The front tape connector and the rear tape connector allow modular removal ability of the suspension frame, channel frame and support structure from the base.

BRIEF DISCUSSION OF THE DRAWINGS

Figure 1:
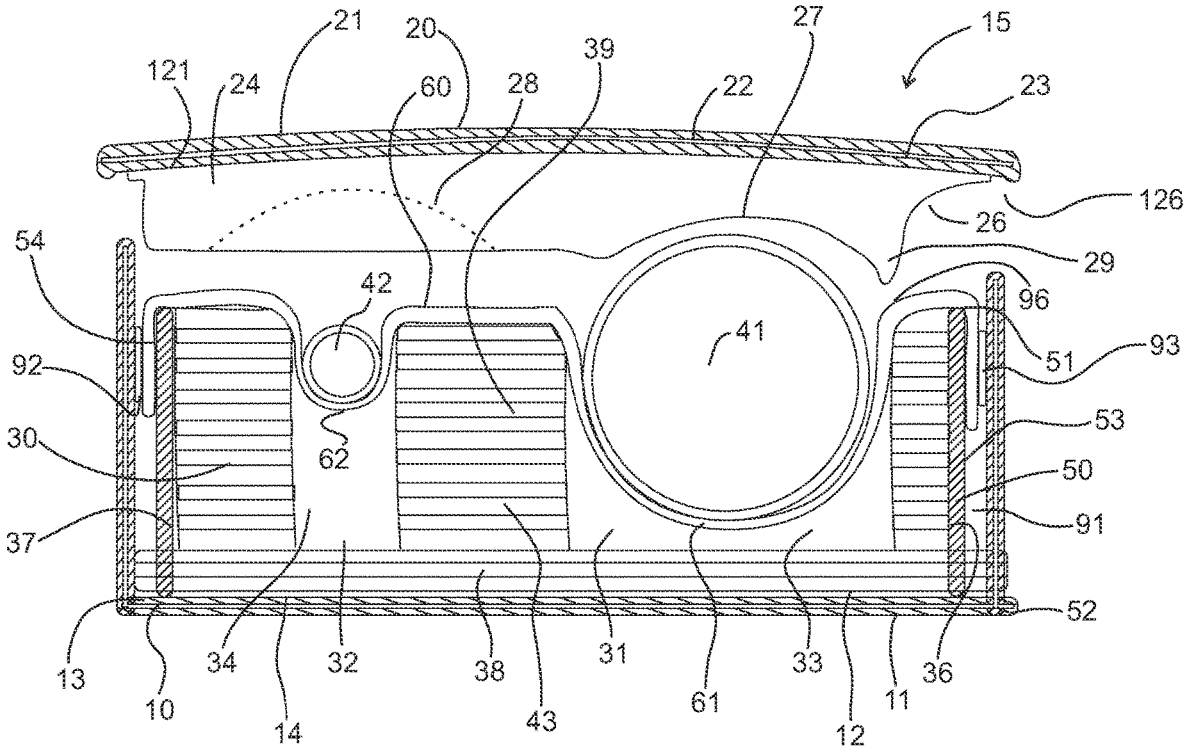
FIG. 1 is an exploded first horizontal cross-section view.

The following call out list of elements can be useful guide in referencing the element numbers of the drawings.

10 base
11 base outside fabric layer
12 base inside fabric layer
13 base outside reflective layer
14 base inside reflective layer
15 modular spring bias cavity device
20 cover
21 cover outside fabric layer
22 cover outside reflective layer
23 cover inside reflective layer
24 cover cushion
25 hinge side
26 opening side cushion indent
26 opening side
27 first cover cushion cavity indent
28 second cover cushion cavity indent
29 cushion indent extension
support structure
31 first cavity
32 second cavity
33 first cavity gap
34 second cavity gap
36 support structure front wall
37 support structure rear wall
38 support structure base
39 support structure laminate stack
41 first glass vessel
42 second glass vessel
43 middle support wall
44 right support wall
left support wall
46 front support wall
47 rear support wall
50 channel frame
51 channel frame upper edge
52 channel frame lower edge
53 channel frame front section
54 channel frame rear section
55 channel frame left section
60 suspension frame
61 suspension frame cavity
62 second suspension frame cavity
63 suspension frame edge
64 front suspension frame overlap
65 rear suspension frame overlap
66 suspension frame front corner
67 suspension frame rear corner

70 side external wall
71 front fabric wall
72 front fabric wall inside reflective layer
73 front fabric wall outside reflective layer
74 front fabric wall inside layer
75 front fabric wall outside layer
76 rear fabric wall
77 rear fabric wall inside reflective layer
78 rear fabric wall outside reflective layer
79 rear fabric wall outside layer
81 hollow passage
91 front gap
92 rear grip
93 front tape connector
94 rear tape connector
96 front engagement shoulder
121 cover inside fabric layer
126 opening side
126 closing side cushion indent
126 opening side
145 channel frame right section
179 rear fabric wall inside layer

DETAILED DESCRIPTION OF THE PREFERRED EMBODIMENT

As seen in FIG. 1, the modular spring bias cavity device 15 has shock protection and thermal insulation in a hand carried configuration. The modular spring bias cavity device includes a cover 20. The cover 20 has a multiple layer structure including a cover outside fabric layer 21 and a cover inside fabric layer 121. A space between the cover outside fabric layer 21 and the cover inside fabric layer 121 has a double reflective layer which includes a cover outside reflective layer 22 and a cover inside reflective layer 23. The cover cushion 24 is mounted to the cover inside fabric layer 121 to form a cushioning lid. The cushioning lid is formed as the cover which is pivotally mounted to the base 10.

The cover cushion 24 is contoured with a pair of indents including a first cover cushion cavity indent 27 and a second cover cushion cavity indent 28. The pair of indents are formed between the hinge side 25 and the opening side 126. The opening side cushion indent 26 rests upon the front engagement shoulder 96 and the cushion indent extension 29 extends downwardly from the opening side cushion indent 26 and extends downwardly from the first cover cushion cavity indent 27. The cover cushion cooperates with a support structure 30 mounted in a base 10.

The base 10 has a base outside reflective layer 13 and a base inside reflective layer 14. The base outside reflective layer 13 faces the base inside reflective layer 14. The base outside reflective layer is preferably laminated onto an inside surface of the base outside fabric layer 11. The base inside reflective layer 14 is preferably laminated to an exterior surface of the base inside fabric layer 12.

The base 10 supports a support structure 30. The support structure 30 has a support structure rear wall 37 that is snugly biased inwardly with a channel frame rear section 54. A channel frame 50 fits into a channel between the suspension frame 60 and the support structure 30. The channel frame has a channel frame rear section 54, a channel frame front section 53, a channel frame left section 55 and a channel frame right section 145. The channel frame is rigid in a vertical direction and flexible in a horizontal direction. The channel frame is preferably made of an elongated plastic extrusion that has been heat formed to conform to the external profile of the support structure 30.

The channel frame 50 has a channel frame upper edge 51 that engages a front engagement shoulder 96, and a channel frame front section 53 that abuts the suspension frame 60. The channel frame lower edge 52 preferably abuts the base inside fabric layer 12. The channel frame 50 can be a hollow member and formed of a horizontally disposed extrusions having horizontal hollow portions. The horizontal hollow portions form a gap to provide additional insulation while absorbing shock and being more flexible. The horizontal hollow portions form a plurality of vertically stacked hollow passages 81. The vertically stacked hollow passages 81 provide a resiliency to impact and distribute the impact against the support structure rear wall 37 for example if the rear portion received an impact such as by dropping.

The support structure 30 has a support structure base 38 with cavities such as a first cavity 31 and a second cavity 32. The first cavity 31 has a first cavity gap 33 and the second cavity 32 has a second cavity gap 34.

A suspension frame 60 can be formed of a molded sheet of plastic. The suspension frame 60 preferably includes a first suspension frame cavity 61 and a second suspension frame cavity 62. A first glass vessel 41 fits in the first suspension frame cavity 61 and a second glass vessel 42 fits in the second suspension frame cavity 62. The first suspension frame cavity 61 is suspended above the base with a first cavity 33 between the first suspension frame cavity and the base. The suspension 60 is flexible and resilient such that acts as a spring during impact such as from a drop.

The first glass vessel 41 and the second glass the 42 can be wine bottles that are oriented with the wine bottle bodies opposing each other. A middle support wall 43 cushions the first glass vessel 41 from the second glass vessel 42. The support structure 30 suspends the suspension frame 60.

A front gap 91 and a rear gap 92 are formed between the channel frame 50 and the fabric walls, namely the front fabric wall 71 and the rear fabric wall 76. A rear tape connector 94 and a front tape connector 93 connect the channel frame 52 the side external walls 70. The tape connectors can be hook and loop tape.

Figure 2:
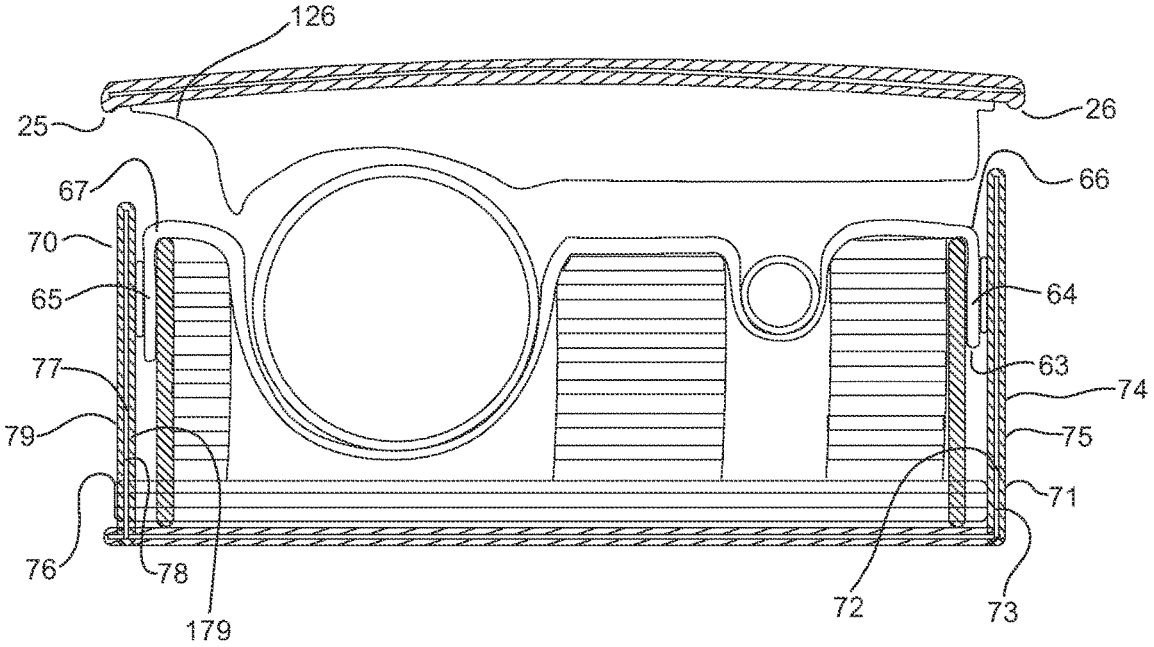
FIG. 2 is an exploded second horizontal cross-section view.

As seen in FIG. 2, the suspension frame 60 has a front suspension frame overlap 64 extending downwardly over a channel frame 50 to a suspension frame 63. The front suspension frame overlap 64 is sandwiched between the channel frame 50 and the tape connectors. The suspension frame 60 has a suspension frame front corner 66 which receives the channel frame upper edge 51. The suspension frame also has a rear suspension frame corner 67 which also receives the channel frame upper edge 51.

The cushion indent extension 29 also extends from the hinge side 25. The closing side cushion indent 126 engages the rear engagement shoulder 95. When the rear suspension frame overlap 65 fits over the suspension frame 50, the suspension frame rear corner 67 rests upon the channel frame upper edge 51.

Figure 3:
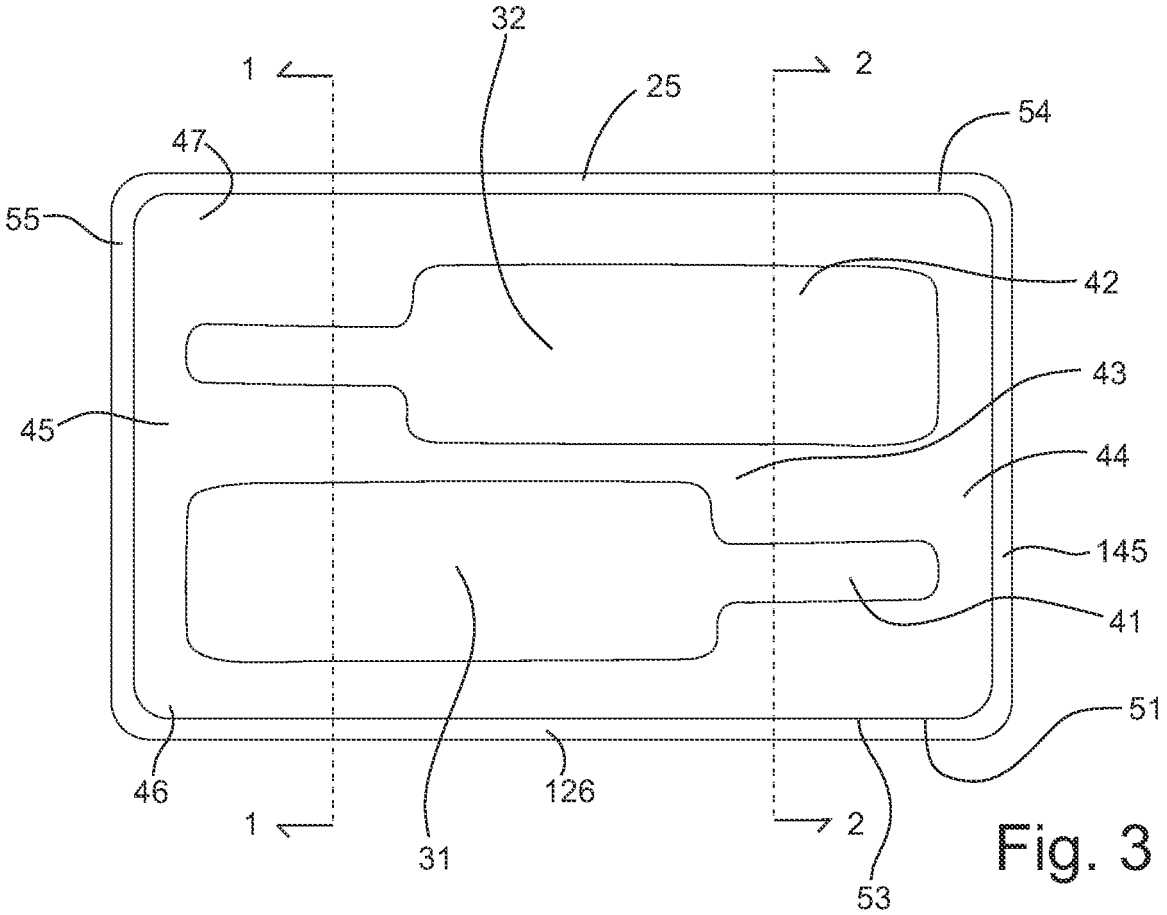
FIG. 3 is a top view diagram.

As seen in FIG. 3, the base 10 includes sidewalls such as a front base wall, a rear base wall, a left base wall, and a right base wall. The support structure front wall 36 support is preferably in snug press fit with the channel frame 50. The support structure 30 has a support structure laminate stack 39 which is formed by stacks of sheets of foam. The support structure 30 can have a front support wall 46, a rear support wall 47, a left support wall 45, and a right support wall 44. The front support wall 46 faces the opening side 26 and the rear support wall 47 faces the hinge side 25. The channel frame left section 55 supports the left support wall 45. The channel frame rear section 54 supports the rear support all 47. The channel frame right section 145 supports the right support wall 44.

Figure 4:
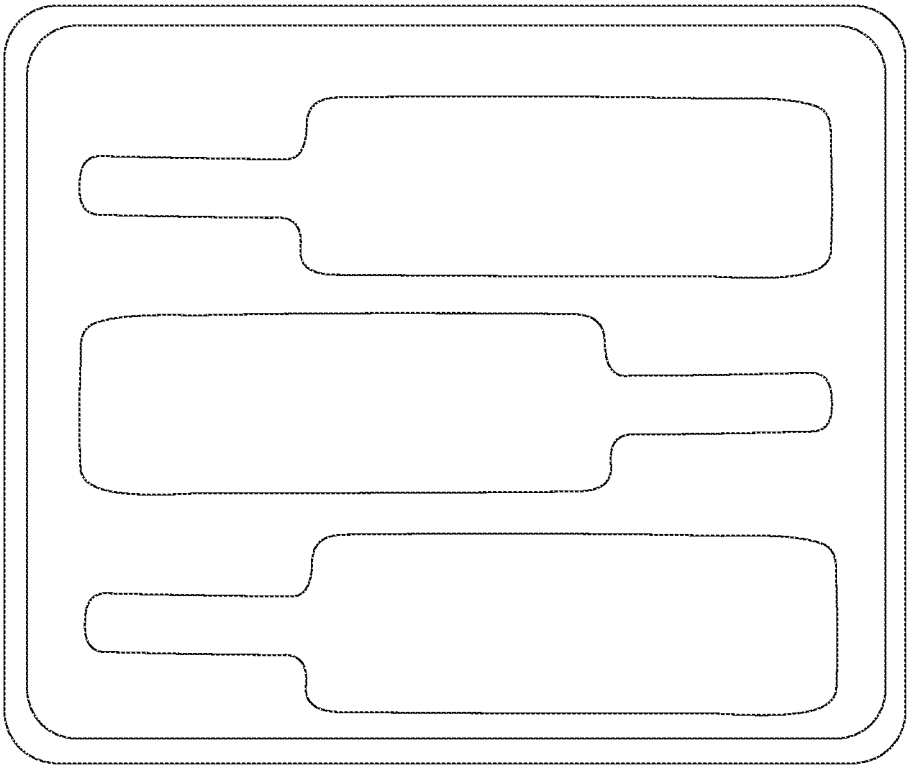
FIG. 4 is a second embodiment top view diagram showing a three bottle carrier.

As seen in FIG. 4, the present invention can be built as a three bottle carrier.

Figure 5:
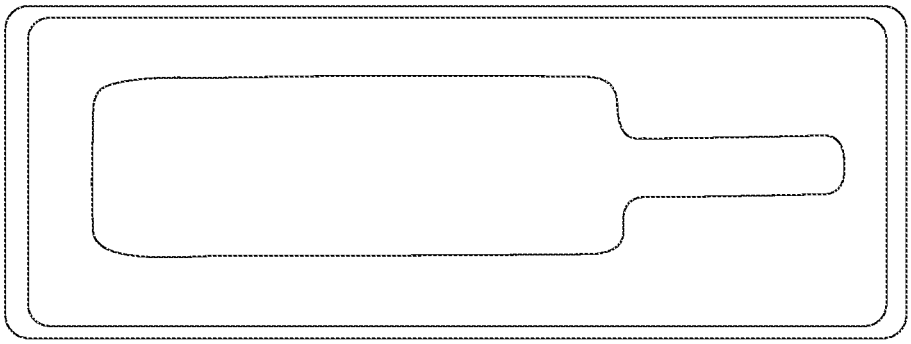
FIG. 5 is a third embodiment top view diagram showing a single bottle carrier.

As seen in FIG. 5, the present invention can be built as a single bottle carrier.

Figure 6:
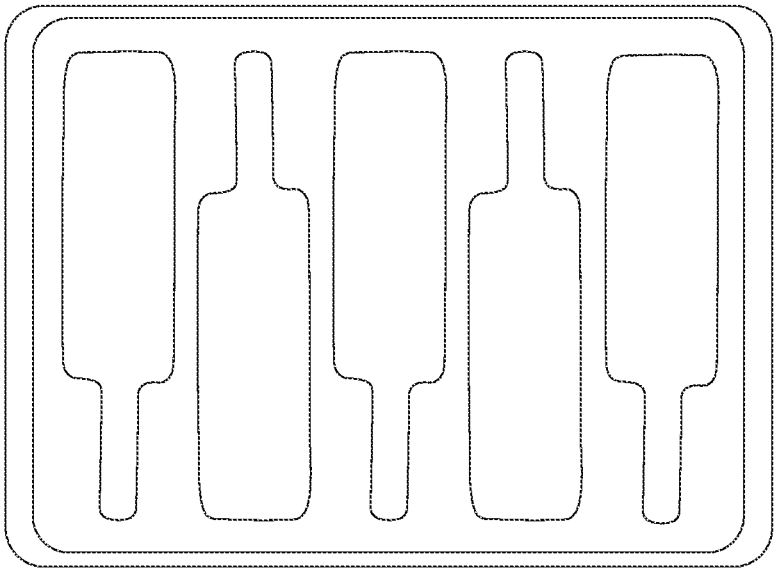
FIG. 6 is a fourth embodiment top view diagram showing a five bottle carrier.

As seen in FIG. 6, the present invention can be built five bottle carrier.

Figure 7:
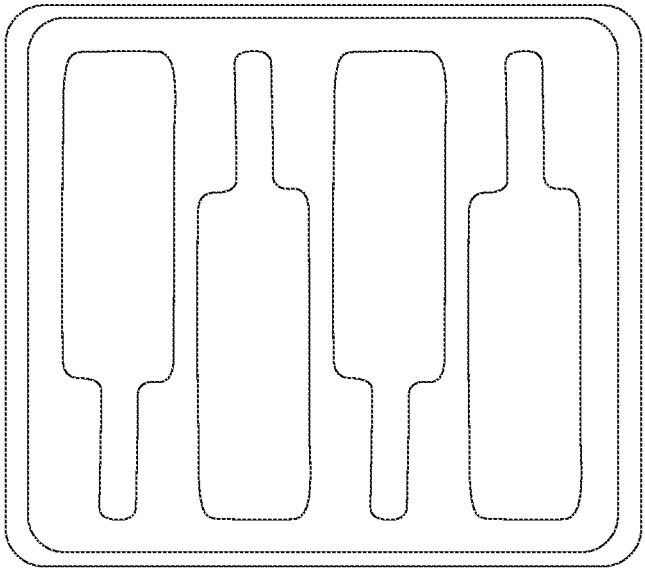
FIG. 7 is a fifth embodiment top view diagram showing a four bottle carrier.

As seen in FIG. 7, the present invention can be built as a four bottle carrier.

Figure 8:
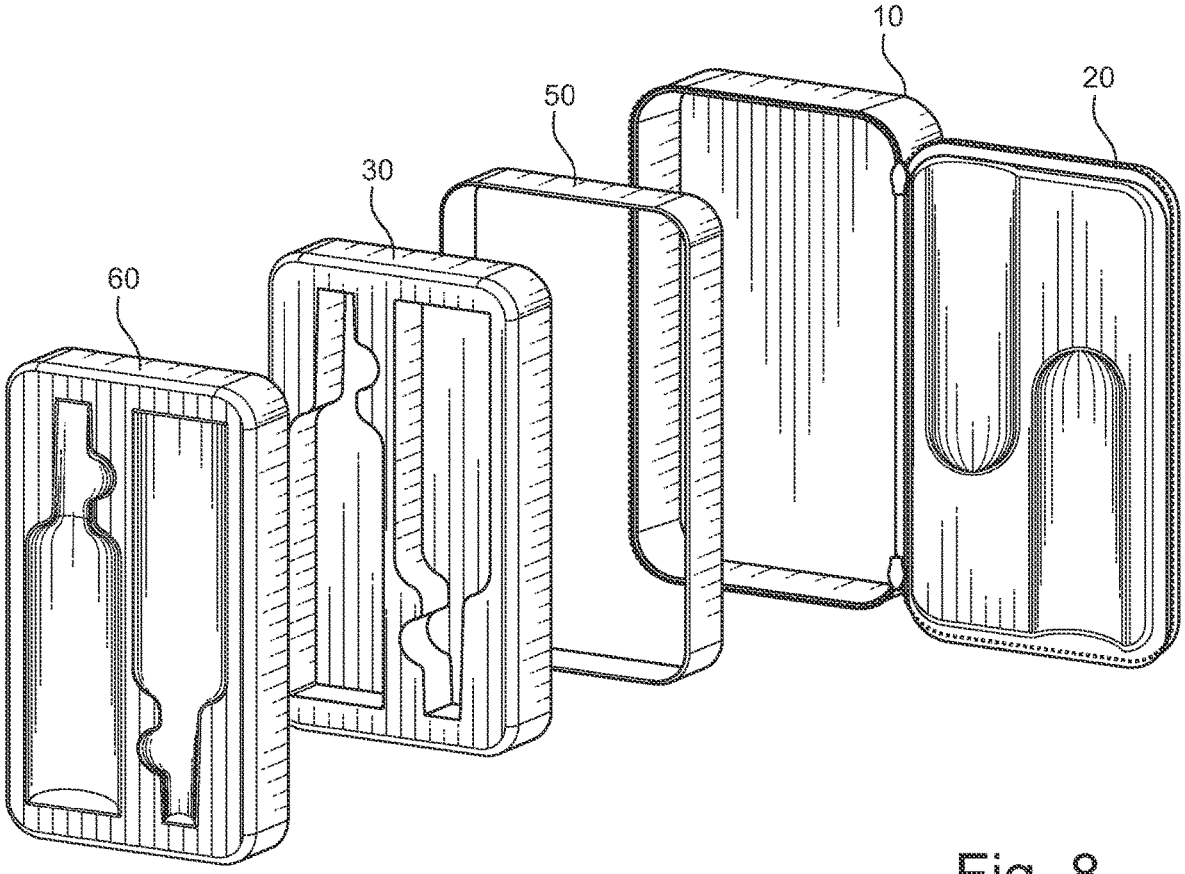
FIG. 8 is an exploded view diagram of the modular spring bias cavity.

As seen in FIG. 8, the exploded view of modular spring bias cavity shows that channel frame 50 can be moved from the base 10 and the lid 20. The support structure 30 and the suspension frame 60 can also be removed from the base 10 and the lid 20.

Figure 9:
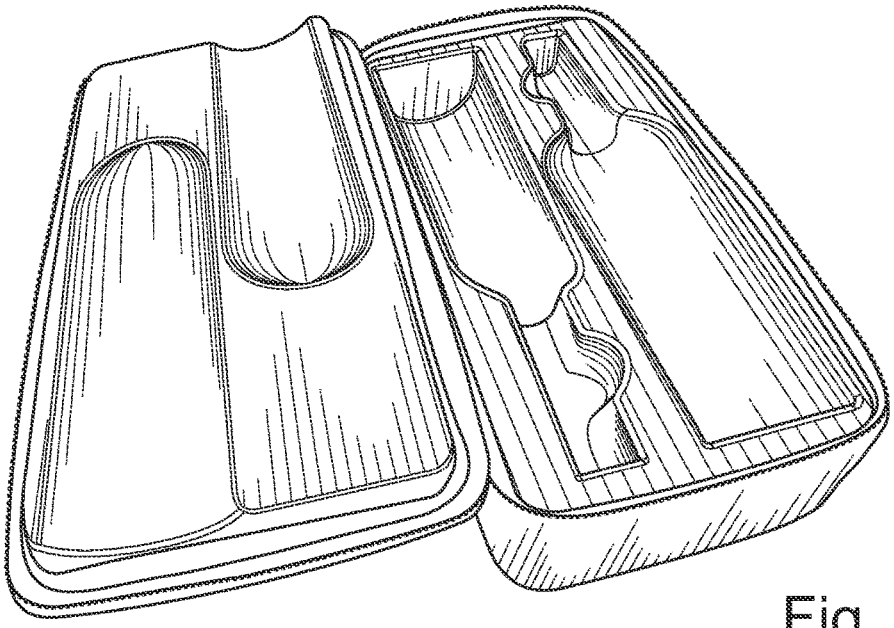
FIG. 9 is a perspective view showing the contour of the modular spring bias cavity.
Figure 10:
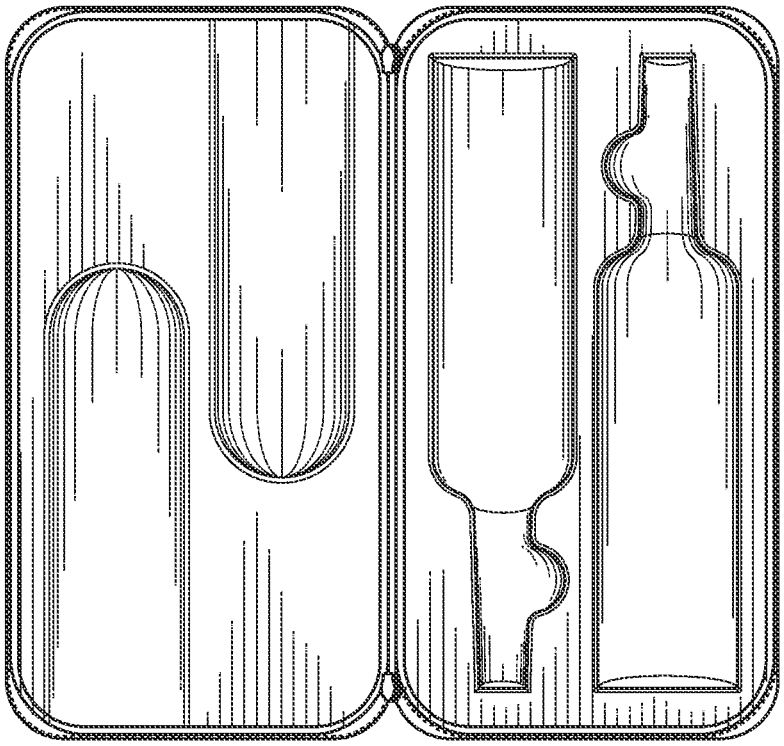
FIG. 10 is a top view with the cover open.
Figure 11:
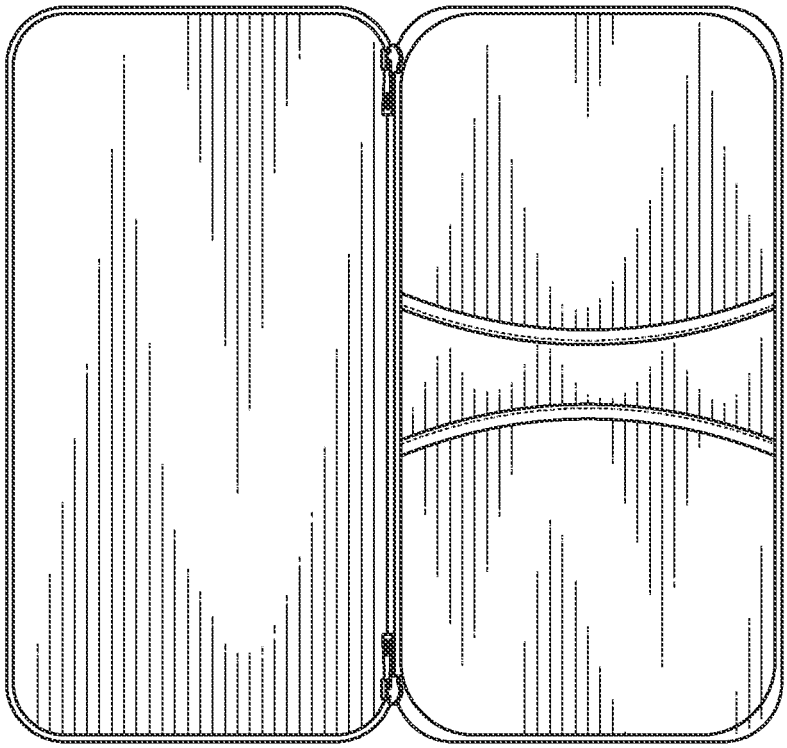
FIG. 11 is a bottom view with the cover open.
Figure 12:
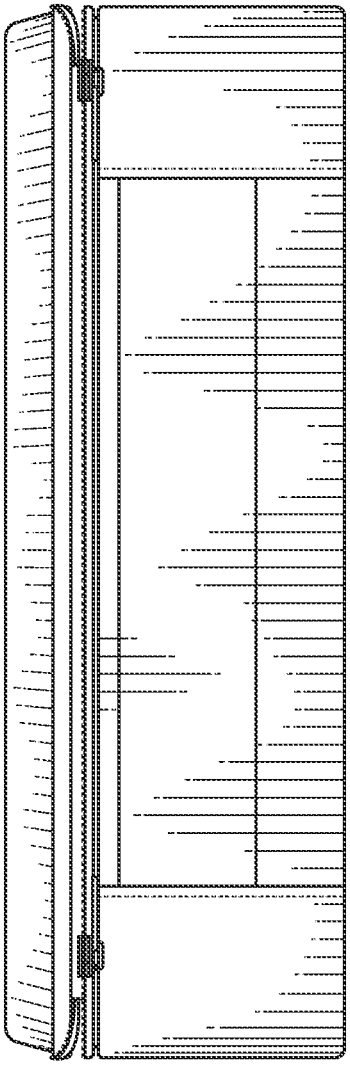
FIG. 12 is a front view with the cover open.
Figure 13:
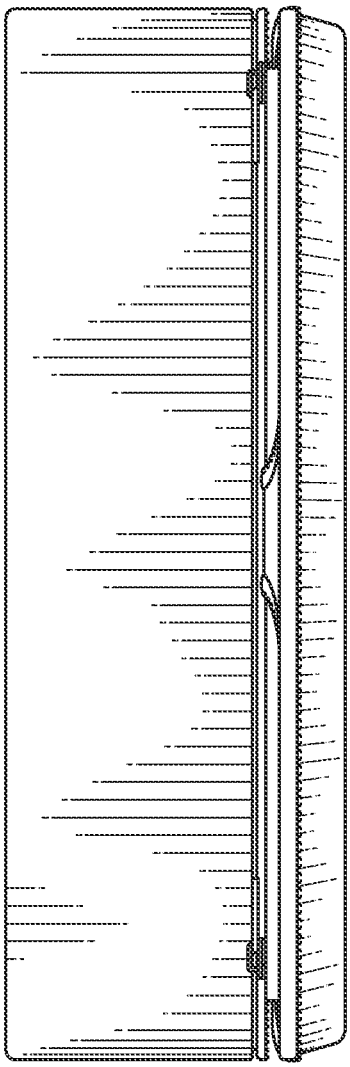
FIG. 13 is a rear view with the cover open.
Figure 14:
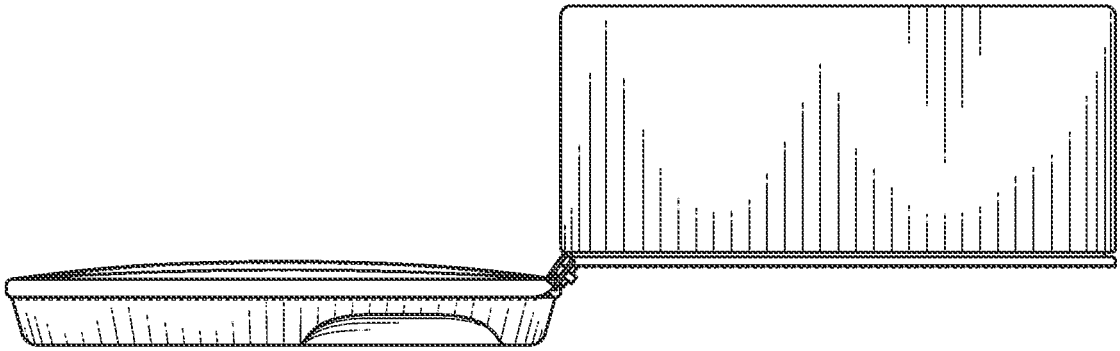
FIG. 14 is a side view with the cover open.
Figure 15:
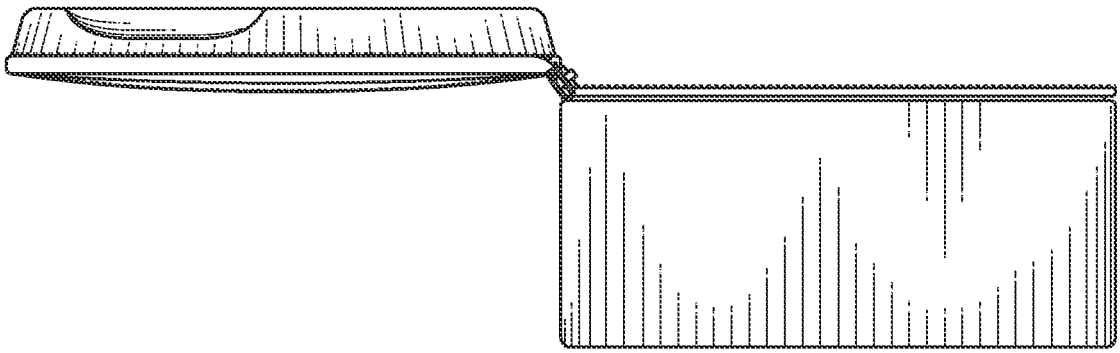
FIG. 15 is a side view with the cover open.

As seen in FIG. 9. A perspective view of the present invention shows the general outline of the depth of suspension cavity during use.

As seen in FIGS. 10-15, the present invention is shaped as carry luggage.

The invention claimed is:

1. A modular spring bias cavity device comprising:

a. a base;

b. side external walls extending from the base;

c. a cover fitting over the side external walls, wherein the cover is connected to the base at a hinge, wherein the cover has a multiple layer structure including a cover outside fabric layer and a cover inside fabric layer, wherein a space between the cover outside fabric layer and the cover inside fabric layer has a double reflective layer which includes a cover outside reflective layer and a cover inside reflective layer, wherein a cover cushion is mounted to the cover inside fabric layer to form a cushioning lid;

d. a support structure having a support structure first cavity, wherein the support structure is mounted to the base;

e. a suspension frame having a first suspension frame cavity that fits over the support structure first cavity, wherein the suspension frame is formed as a resilient and flexible structure;

f. a suspension frame overlap that extends downwardly at a periphery of an extension frame, wherein the suspension frame overlap overlaps the support structure; and g. a channel frame mounted to the support structure around a support structure sidewall, wherein the channel frame fits within a channel formed between the suspension frame overlap and the support structure.

2. The modular spring bias cavity of claim 1, wherein the cover cushion further includes a first cover cushion cavity indent conforming to a profile of the first suspension frame cavity.

3. The modular spring bias cavity of claim 1, wherein the cover further includes an opening side cushion indent, wherein the opening side cushion indent rests upon a front engagement shoulder of the suspension frame.

4. The modular spring bias cavity of claim 1, wherein the channel frame is more rigid in a vertical orientation than in a horizontal orientation.

5. The modular spring bias cavity of claim 1, wherein the support structure has a first suspension cavity and a second suspension cavity, wherein the cover has a first cover cushion cavity indent and a second cover cushion cavity indent, wherein the first cover cushion cavity indent is aligned to the first suspension cavity, and wherein the second cover cavity indent is aligned to the second suspension cavity, wherein the base further includes a base outside reflective layer and a base inside reflective layer wherein the base outside reflective layer faces the base inside reflective layer, wherein the base outside reflective layer is laminated onto an inside surface of the base outside fabric layer, wherein the base inside reflective layer is laminated to an exterior surface of the base inside fabric layer.

6. The modular spring bias cavity of claim 5, wherein the suspension frame has a suspension frame rear corner toward a hinge side, wherein the cover has a closing side cushion indent that engages with a rear engagement shoulder formed on the support structure.

7. The modular spring bias cavity of claim 5, wherein the suspension frame suspends the first suspension cavity above a first cavity gap, wherein the first cavity gap is formed between the first suspension cavity and the support structure.

8. The modular spring bias cavity of claim 7, wherein the suspension frame suspends the second suspension cavity above a second cavity gap, wherein the second cavity gap is formed between the second suspension cavity and the support structure.

9. The modular spring bias cavity of claim 8, wherein the cover cushion further includes a first cover cushion cavity indent conforming to a profile of the first suspension frame cavity.

10. The modular spring bias cavity of claim 8, wherein the cover further includes an opening side cushion indent, wherein the opening side cushion indent rests upon a front engagement shoulder of the suspension frame.

11. The modular spring bias cavity of claim 8, wherein the channel frame is more rigid in a vertical orientation than in a horizontal orientation.

12. The modular spring bias cavity of claim 1, further including: a front tape connector connecting the suspension frame to a first side external wall of the side external walls, and a rear tape connector connecting the suspension frame to a second side external wall of the side external walls, wherein the front tape connector and the rear tape connector allow modular removal ability of the suspension frame, channel frame and support structure from the base.

13. The modular spring bias cavity of claim 12, wherein the cover cushion further includes a first cover cushion cavity indent conforming to a profile of the first suspension frame cavity.

14. The modular spring bias cavity of claim 12, wherein the cover further includes an opening side cushion indent, wherein the opening side cushion indent rests upon a front engagement shoulder of the suspension frame.

15. The modular spring bias cavity of claim 12, wherein the channel frame is more rigid in a vertical orientation than in a horizontal orientation.

16. The modular spring bias cavity of claim 12, wherein the support structure has a first suspension cavity and a second suspension cavity, wherein the cover has a first cover cushion cavity indent and a second cover cushion cavity indent, wherein the first cover cushion cavity indent is aligned to the first suspension cavity, and wherein the second cover cavity indent is aligned to the second suspension cavity.

* * * * *